US006158919A

United States Patent [19]

Landes

[11] Patent Number: 6,158,919

[45] **Date of Patent: *Dec. 12, 2000**

[54] EXTENDED LIFE MARKER POST

[76] Inventor: Scott D. Landes, 9906 Kell Ave. S., Bloomington, Minn. 55437

[ * ] Notice: This patent issued on a continued prosecution application filed under 37 CFR 1.53(d), and is subject to the twenty year patent term provisions of 35 U.S.C. 154(a)(2).

[21] Appl. No.: 09/013,254

[22] Filed: Jan. 26, 1998

[51] Int. Cl.[7] ..... E01F 9/011

[52] U.S. Cl. ..... 404/9; 404/10; 256/19; 116/63 R

[58] Field of Search ..... 404/6, 9, 10; 256/1, 256/13.1, 19; 40/607, 608, 671; 116/63 R

[56] References Cited

U.S. PATENT DOCUMENTS

| | | | |
|---|---|---|---|
| 4,092,081 | 5/1978 | Schmanski | 404/10 |
| 4,123,183 | 10/1978 | Ryan | 404/10 |
| 4,169,180 | 9/1979 | McDonagh | 428/215 |
| 4,240,766 | 12/1980 | Smith et al. | 404/10 |
| 4,249,357 | 2/1981 | Cornou | 52/736.3 |
| 4,939,037 | 7/1990 | Freeman et al. . | |
| 5,037,680 | 8/1991 | Papendick et al. | 428/31 |
| 5,254,192 | 10/1993 | Speakman | 156/94 |

FOREIGN PATENT DOCUMENTS

| | | | |
|---|---|---|---|
| 2069032 | 10/1980 | United Kingdom | 404/9 |

OTHER PUBLICATIONS

Repnet PolyShied Hydrant Marker Jan. 1996, Techsheet #R530, Repnet, Inc.

*Primary Examiner*—James A. Lisehora
*Attorney, Agent, or Firm*—Jacobson & Johnson

[57] ABSTRACT

A marker post having a breachable coating for providing a visual indication of the presence of an object, with the marker post comprised of glass fibers supported in a resin containing a secondary pigment to provide an internal color to the marker post, and with the breachable coating containing an ultraviolet blocking agent, with the breachable coating having a principle pigment of a color that is the same or substantially the same color as the secondary pigment in the resin so that in the event the breachable coating having the principle color pigment is breached, the underlying secondary pigment in the resin will be visible through the breached coating so that a viewer observing the marker post from a distance will see the marker post as one color even though two distinct surfaces of the marker post are exposed.

9 Claims, 2 Drawing Sheets

EXTENDED LIFE MARKER POST

THE INVENTION

This invention relates generally to marker posts and, more specifically, to a marker post that, in spite of having a breachable coating, can maintain its visual appearance over an extended period of time.

BACKGROUND OF THE INVENTION

Oftentimes, people working in an area need to be alerted to underground hards such as power lines or pipelines. One way of doing so is to place a marker post above ground with the marker post carrying information to alert people to the hazardous underground utilities. One such marker post is shown in Schmanski U.S. Pat. No. 4,092,081 which discloses a reinforced plastic post that can be driven in the ground and still have sufficient flexibility to bend and flex if impacted by an object. Schmanski teaches the use of marker posts with glass fiber embedded in a resin core so that the combination of the glass fibers and the resin core provides both strength and flexibility to the marker post Schmanski suggests that the marker have a surface covering to protect the binder fiber combination from weather, ultraviolet rays and other adverse effects of the environment. Schmanski does not suggest painting the exterior of the marker post with a breachable coating. Still other types of marker use a fiberglass core and a UV stabilized outer wall that is molded or extruded around the fiberglass core to reduce fading and prevent glass fibers from reaching the surface.

As underground utilities are intended for extended use, the above-ground marker post should have a similar long life. To provide the needed visual awareness, the marker post needs to be have a bright color that is clearly visible against the background. In addition, the same color marker post should be used for each application. For example, a yellow marker post can be used to identify one type utility line, and a red marker post could be used to identify another type of underground hazard. These brightly colored posts visually alert those in the vicinity of the marker post to the presence of an underground hazard.

In most instance the color of the posts is mandated by the state or the industry code as it is desired to have the color of the post convey information to an observer. Consequently, it is important that the color be retained over the life of the post. Unfortunately, the present methods of providing color retention result in the color of the post fading until the color of the post takes on a whiteish color.

To provide the proper permanent color to the marker posts, a colored pigment is added to the resin used to make the marker post. Breachable coatings, such as paints, are avoided in marker posts as normal wear and tear on the marker post causes the breachable coating to flake or scratch off, resulting in loss of color to the marker post. In contrast, by adding the colored pigment to the resin, it produces a marker post that will retain its color even if the post is scratched because the pigment is located throughout the resin in the marker post. That is, by incorporating the colored pigment into the construction of the post itself as opposed to painting the post with a colored pigment, one is assured that even if the marker post is damaged, the post will maintain its original color. Consequently, relying on exterior coatings to provide a permanent color is avoided because scratches to the exterior coating destroy the original color of the post.

Although scratches to the marker post do not change the color of the marker post that have the color pigment dispersed throughout the resin, it has been found that the marker post's surface color fades due to exposure to the environment. Consequently, having the pigment located throughout the resin can fail to maintain the original exterior color of the post over an extended period of time. The surface breakdown can occur from numerous sources, but one of the most troubling sources is the environmental breakdown that results in bloom Bloom is generally defined as a non-continuous surface coating on plastic products that comes from ingredients, such as plasticizers, lubricants, and anti-static agents, which comes out of the solution of the resin and migrate to the surface of the resin. Bloom is generally the result of gamma rays in the sunlight breaking down the molecules in the resin surrounding the glass fibers on the surface of the resin. With the evaporation of the resin in the marker post, the glass fibers are somewhat loose, and the memory retained in the glass fibers causes the fibers to propagate outward. The breakdown occurs within a few thousandths of an inch of the surface and has very little effect on the mechanical properties of the post; however, the surface appearance is noticeable as the bloom results in the post losing its original color and taking on the whitish color of the glass fibers. In addition, the migration of glass fibers leaves the marker post in a condition where anyone touching the marker post can get glass slivers.

One solution to prevent bloom on resins containing glass fibers is to use a surface mat on the exterior surface of the resin. However, while the surface mat may prevent the glass fibers from migrating to the surface, it does not prevent the resin from evaporating and changing the color of the post. That is, the polyester mat is white and once the resin evaporates, the post takes on the color of the white polyester mat. In addition, since the polyester mats are only placed on the face or back of the marker it still allows glass particles to migrate out of the edges of the posts.

The present invention provides a long life marker post that minimizes the problem of the fading of the exterior color by utilizing a pigment containing a breachable coating as the principle post color. Although the marker post resin which is located throughout the marker post contains a colored pigment dispersed throughout the resin, the colored resin becomes a secondary color that is not visible unless the outer breachable pigment containing coating is damaged. Thus, in contest with the prior art which avoids breachable pigment containing coatings on the exterior of post, the present invention relies on a breachable pigment containing coating to provide the principle color to the post and the colored resin throughout the post to provide a secondary color only in the event that there is a failure of the breachable coating.

In the present invention, the exterior surface of the marker post is coated with a non-transparent, breachable coating containing an ultraviolet-blocker that contains the same or substantially the same color pigment as the resin in the marker post. The result is a marker post with an outer breachable ultraviolet coating which blocks or inhibits the gamma rays to prevent breakdown of the resin in the post which causes the bloom that results in color loss. The outer, breachable coating extends the useful life of the marker post by preventing the post from losing its original color due to bloom. Thus, the marker post of the present invention will retain its color longer since the breachable coating on the marker post does not contain resins and glass fibers.

While the coating is described as a breachable coating, it should be understood that the breachable coating can withstand many types of impacts without breaching the coating. However, since the coating does not become an integral part, the resin contained in it can still be separated or scratched off the post if the post receives severe impacts, and for that reason is described as a breachable coating.

Thus, in the present invention, the marker post retains and relies on the original color on the exterior of the marker post. In spite of the fact that the breachable coating on the marker post is still subject to scratches and may be damaged due to subsequent impacts to the marker post, the overall color retention life of the marker post is lengthened because the breakdown of the internal color of the post occurs, if at all, only over time and over limited areas of the post.

In addition to impacts with machines or objects, the marker post is also subject to bending due to weather conditions such as wind and rain. Both of these conditions can cause localized breaching of the outer breachable coating on the marker post. Although breachable coatings such as commercial paints with ultraviolet-blockers which have long life and long color retention are commercially available, unfortunately, a single paint that has sufficient durability to adhere to the marker post and resist scratches under all types of field conditions is difficult to find. Consequently, while one coating might work in one marker post application, it might not work in another marker post application. For example, if a marker post is subjected to extreme temperatures, one type temperature-responsive coating may be useful, and if another marker post is subjected to repeated impact, another more flexible type of coating may be more suitable.

The present invention reduces the need for having a single paint coating that is responsive for each field condition by matching the field use to the paint type. For example, to have long life marker posts one selects a long life paint that contains an ultraviolet-blocking agent and has the same color pigment or substantially the same color pigment as the pigment in the resin of the marker posts. Consequently, minor damage or localized breaching of the exterior breachable coating on the marker post that can occur over time and which can result in loss of a portion of the breachable coating does not render the marker post ineffective. That is, the internal resin of the marker post carries a pigment, and the exterior breachable coating contains a pigment of the same or substantially the same color so that if the marker post is damaged, the original color will appear in the exposed area where the coating is removed. Consequently, the marker post will appear to be the same color to an observer even though portions of the breachable coating are not present.

In addition, if a protective mat or coating is used on the exterior surface of the resin and below the exterior breachable coating, the exposed portion of the marker post can still resist bloom unless the protective mat is breached. Thus, with the prevent invention, even though the marker post exterior coating is breached, the life of the marker post original color has been extended because the process of the color breakdown is inhibited through the use of a set of barriers which coact to provide a post whose color can be retained over an extended period of time.

DESCRIPTION OF THE PRIOR ART

U.S. Pat. No. 4,092,081 and its reissue 32,045 disclose a marker or guide which is made from fiber-reinforced resins which permit the marker to have sufficient flexibility to bend in response to impact, with the marker having a surface covering to protect the binder-fiber combination from weather, ultraviolet rays and other adverse effects of the environment.

SUMMARY OF THE INVENTION

A marker having a breachable coating for providing a visual indication of the presence of an object, with the marker post comprised of glass fibers supported in a resin containing a first pigment to provide a first color to the marker post, and the breachable coating having an ultraviolet blocking agent therein, with the breachable coating having a pigment of a second color therein that is the same or substantially the same color as the pigment of the first color in the resin so that, in the event of damage to the breachable coating, the underlying pigment in the resin will be visible so that a viewer observing the marker post from a distance will see the marker post as one color.

DESCRIPTION OF THE PREFERRED EMBODIMENT

Figure 1:
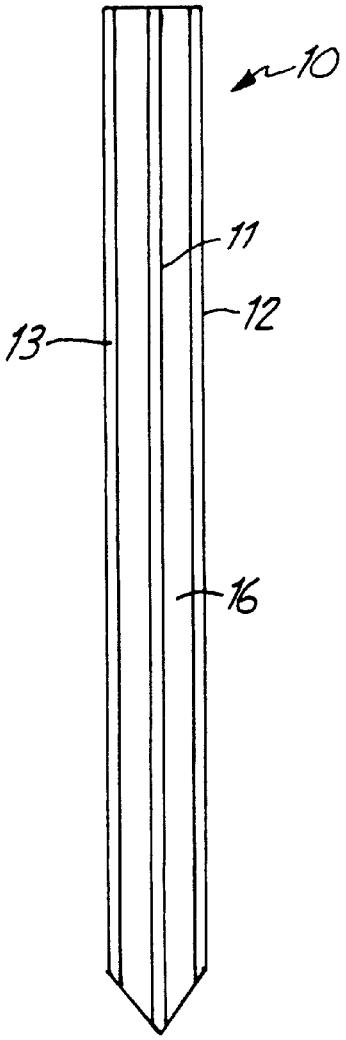
FIG. 1 is a front view of an elongated marker post for providing an above-ground warning of an underground hazard.

FIG. 1 shows a front view of an elongated marker post 10 for providing an above-ground warning of an underground hazard. Marker post 10 includes reinforcing ridges 11, 12 and 13 to provide rigidity to the elongated marker post 10.

Figure 2:
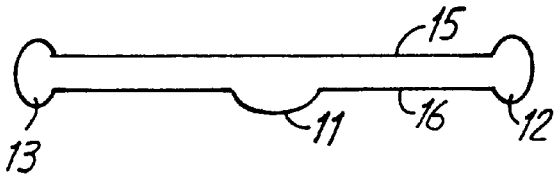
FIG. 2 is a top view of the elongated marker post of FIG. 1.

FIG. 2 is a top view of the elongated marker post of FIG. 1 showing the narrow profile which enables the marker post to bend and flex. If desired, decals or warning labels can be placed on elongated surfaces 15 and 16. Marker post 10 is of the type that is sufficiently rigid to be driven into the ground by pounding on the end of the post, but sufficiently flexible to bend and flex in response to lateral impacts.

Figure 3:
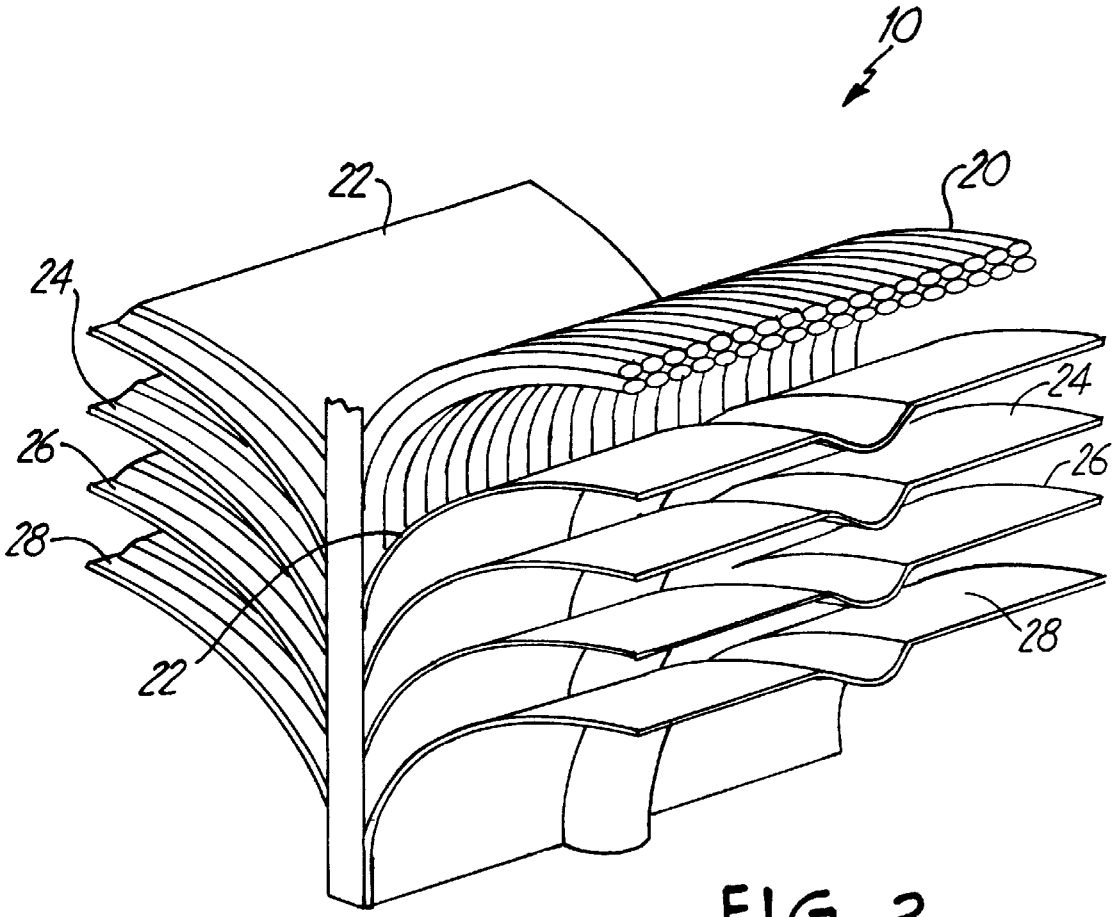
FIG. 3 is a partial exploded view to illustrate the various layers in the elongated marker post.

To understand the composition of the marker post 10 which provides it with its unique properties, refer to FIG. 3 which shows a partial exploded view that shows the layers of the post bent outward to reveal the various components of the marker post.

Marker post 10 contains a plurality of strands 20 of glass fibers which extend through the center of the post to provide compressive strength to the post. Each strand contains filaments of glass fibers which are spun together and bounded to one another by polyester resin. The polyester resin, in conjunction with the strands of glass fibers, gives the post the stiffness to ensure that one can drive the marker into most soils while still providing the flexibility to withstand repeated impacts.

Located on each side of strands 20 are layers of cross-woven glass fibers 22 which are embedded in the resin to provide cross-strength reinforcement which provides the post with high strength in the transverse direction to thereby eliminate splitting.

Located on the exterior of fibers 22 are surface mats 24, which are typical polyester. The surface are used to provide a smooth finish that normally inhibits the glass fibers from migrating to the surface as the resin evaporates. Mats 24 are also embedded in the polyester resin.

To prolong the life of the marker post, thin layers of resin 26 cover the surface mats 24 and act as a shield to protect the marker post 10 from the elements. Throughout the polyester resin, there is included a pigment that provides the desired color to the marker post. Thus, the marker post 10 includes a central core 20, a pair of cross layers 22, a pair of surface mats 24 and surface shields 26 that protect the surface of the marker post 10 from the elements. The marker post 10 in this condition is normally suitable for most field use. In the present invention, I provide an additional non-transparent breachable coating that covers the colored resin. Even though my coating is breachable, I can extend the life of the post by inhibiting the color fading of the post.

FIG. 3 shows my outer breachable coatings 28 which are located on the exterior of the marker post 10. The outer breachable coatings 28 envelope the exterior of the marker post and contains a conventional agent that blocks ultraviolet light from the surface of the post. In the preferred embodiment, breachable coating 28 comprises a long life acrylic paint that can maintain its original color for an extended period of time. While paints are available for covering structure and the like, numerous paints have ultraviolet blocking agents that provide the paint with the ability to absorb or block ultraviolet rays.

Typically, a suitable breachable coating 28 can be found in the commercially available paints that contain an ultraviolet blocking agent. The paint used on the post is selected on the basis that it contains a pigment that closely matches the pigment used in the resin. In the present invention, one selects a paint which contains a pigment that has a color identical or substantially similar to the color of the pigment used in the resin in the marker post. Various paints can be used and, if desired, the characteristics of the paint can be matched with the intended use of the marker post. For example, one type of paint may be used in environments which have extreme temperature ranges and another type of paint may be used in protective areas. In addition, the paint should be of a type which adheres to the resin in the post. Coating thickness may vary, but coating which has a thickness of at least 0.008 inches is suitable for use with the present invention.

By selecting a paint that contains a pigment that has the same color or substantially the same color as the pigment in the resin, one can make a breachable coated marker post that can actually maintain its color for an extended period of time that is longer than if the marker post did not have a breachable coating even though the breachable coating may from time to time be breached.

The use of the term breachable coating herein is intended to include a covering that can withstand a certain amount of impact without breaching but can be breached or penetrated if the impact is substantially aggressive. The important aspect of the breachable coating is that it can absorb some impacts and prevent those impacts from aptly breaching the coating, but the coating will normally be breached at least a portion of the time which exposes the underlying resin. However, since the underlying resin is usually only exposed in small areas and may not be exposed into well into the life of the post, the breaching of the coating does not shorten the life of the post since the aging of the post occurs after the post has been placed in the field.

Thus the present invention also includes the method of making a marker post for providing a visual indication of the presence of a condition comprising the steps of mixing a secondary pigment in a hardenable resin to provide a secondary color throughout hardenable resin. One can placing glass fibers in the hardenable resin to obtain the structural integrity. The glass fibers and hardening resin can be molded the into a marker post. Next one allows the hardenable resin to cure to a solid state to form a rigid marker post that would normally be ready to use. However in the present invention one applies a breachable coating in liquid form to the marker post, with the breachable coating having a pigment of a principle color therein that is the same or substantially the same color as the secondary pigment so that, in the event of a breach of the breachable coating on the marker post, the underlying secondary pigment will be visible through the breach so that, to a viewer observing the marker post from a distance, the marker post appears as one color. If an acrylic paint is used as the breachable coating it can be applied at room temperature.

I claim:

1. An elongated, extended-life marker post, said elongated, extended-life marker post for carrying information thereon, said elongated, extended-life marker post having a first end for securing the post in an upright position and an opposite end for pounding thereon to drive said marker post into the upright position;

a plurality of glass strands, said plurality of strands running a lengthwise direction to provide sufficient stiffness to ensure installation and sufficient flexibility to bend add return to an upright vertical condition;

a plurality of glass fibers, said plurality of glass fibers located in a transverse direction to provide strength to said post in a transverse direction;

a surface mat proximate said plurality of glass fibers, said surface mat providing a smooth finish to inhibit bloom on said post;

a layer of resin located around said glass fibers and said glass strands with said resin including a pigment of a first color a first normally obscured color throughout said marker post;

a non-transparent, breachable surface coating containing an ultraviolet blocking agent extending around said post to prevent rays from striking said resin, said breachable surface coating having a second pigment of a second color therein with said second pigment providing the principal color to said marker post with said resin having substantially the same color pigment therein so that, in the event the breachable surface coating should be breached, the underlying color of said resin would be exposed so that a person looking at said marker post from a distance would the marker post as one color.

2. The marker post of claim 1 wherein the resin is a polyester resin.

3. The marker post of claim 1 wherein the strands contain glass fibers secured by a polyester resin.

4. The marker post of claim 1 wherein said breachable surface coating comprises acrylic paint.

5. The marker post of claim 1 wherein breachable surface coating has a thickness of at least 0.008 inches.

6. The marker post of claim 1 wherein the breachable surface coating extends completely around said marker post.

7. The marker post of claim 1 wherein the breachable coating is of sufficient thickness to absorb at least some impacts without breach of said breachable surface coating.

8. A marker post providing a visual indication of the presence of an object, said marker post comprised of glass fibers supported in a resin, said resin containing a secondary pigment to provide a secondary color throughout said marker post; and a breachable surface coating extending over said marker post, said breachable coating having a pigment of a principal color therein that is the same or substantially the same color as the secondary pigment so that, in the event of a breach of the breachable coating and physical damage to the resin, the underlying secondary pigment of the resin will be visible through the breach so that, to a viewer observing the marker post from a distance, the marker post appears as one color.

9. The marker post of claim 8 including a protective mat located over said resin and beneath said breachable surface coat.

* * * * *

UNITED STATES PATENT AND TRADEMARK OFFICE

CERTIFICATE OF CORRECTION

PATENT NO. : 6,158,919
DATED : December 12, 2000
INVENTOR(S) : Scott D. Landes

It is certified that error appears in the above-identified patent and that said Letters Patent is hereby corrected as shown below:

1. An elongated, extended-life marker post, said elongated, extended-life marker post for carrying information thereon, said elongated, extended-life marker post having a first end for securing the post in an upright position and an opposite end for pounding thereon to drive said marker post into the upright position;

a plurality of glass strands, said plurality of glass strands running a lengthwise direction to provide sufficient stiffness to ensure installation and sufficient flexibility to bend <u>and</u> [add] return to an upright vertical condition;

a plurality of glass fibers, said plurality of glass fibers located in a transverse direction to provide strength to said post in a transverse direction;

a surface mat proximate said plurality of glass fibers, said surface mat providing a smooth finish to inhibit bloom on said post;

a layer of resin located around said glass fibers and said glass strands with said resin including a pigment of a first color <u>to provide</u> a first normally obscured color throughout said marker post;

UNITED STATES PATENT AND TRADEMARK OFFICE

CERTIFICATE OF CORRECTION

PATENT NO. : 6,158,919
DATED : December 12, 2000
INVENTOR(S) : Scott D. Landes

It is certified that error appears in the above-identified patent and that said Letters Patent is hereby corrected as shown below:

a non-transparent, breachable surface coating containing an ultraviolet blocking agent extending around said post to prevent ultraviolet rays from striking said resin, said breachable surface coating having a second pigment of a second color therein with said second pigment providing the principle color to said marker post with said resin having substantially the same color pigment therein so that, in the event the breachable surface coating should be breached, the underlying color of said resin would be exposed so that a person looking at said marker post from a distance would see the market post as one color.

Signed and Sealed this

Eighth Day of May, 2001

*Attest:*

Nicholas P. Godici

NICHOLAS P. GODICI

*Attesting Officer*

*Acting Director of the United States Patent and Trademark Office*